United States Patent [19]

Putt

[11] 4,270,660

[45] Jun. 2, 1981

[54] TACO HOLDERS

[76] Inventor: Arthur G. Putt, 5901 Cornell Blvd., North Ridgeville, Ohio 44039

[21] Appl. No.: 12,062

[22] Filed: Feb. 14, 1979

[51] Int. Cl.[3] ..... A47F 7/00

[52] U.S. Cl. ..... 211/13; 211/41

[58] Field of Search ..... 211/13, 41, 194; 99/450.6, 441, 426, 418, 448; 297/239; D6/184; 248/163; D7/206, 207, 211, 212

[56] References Cited

U.S. PATENT DOCUMENTS

| | | | |
|---|---|---|---|
| 116,582 | 9/1939 | Stavely | D6/184 |
| 471,424 | 3/1892 | Hov | 248/163 |
| 1,550,138 | 8/1925 | Baker | 99/426 |
| 1,918,933 | 7/1933 | Rogers | 248/163 X |
| 2,504,237 | 4/1950 | Weissbach | 99/426 |
| 3,708,202 | 1/1973 | Barecki et al. | 297/239 |
| 3,943,320 | 3/1976 | Bowen | 99/441 X |

FOREIGN PATENT DOCUMENTS

| | | | |
|---|---|---|---|
| 167371 | 6/1959 | Sweden | 211/13 |

*Primary Examiner*—Ramon S. Britts
*Assistant Examiner*—Robert W. Gibson, Jr.
*Attorney, Agent, or Firm*—Burge & Porter, Co.

[57] ABSTRACT

A holder for supporting comestible products such as tacos or the like includes an elongate, generally U-shaped carrier. The carrier is made of an opaque, plastic material susceptible of injection molding. In one embodiment, the carrier is supported atop a stand having a plurality of legs of generally equal length, at least one leg being disposed at opposite ends of the carrier. The legs and the carrier are arranged such that a plurality of the holders may be stacked to facilitate compact storage. In another embodiment, a plurality of carriers are aligned atop, and secured to, a legged stand. The stand includes a planar sheet supported at an angle to the horizontal by first and second legs extending outwardly of the planar sheet. The first and second legs are of different lengths and extend outwardly of the sheet at different angles. The stand includes a plurality of slots into which portions of another holder can be fitted to permit compact storage. Yet another embodiment of the invention comprises a free standing holder in which the bottom of the carrier rests atop a flat surface without the need for a stand or other support.

3 Claims, 6 Drawing Figures

TACO HOLDERS

BACKGROUND OF THE INVENTION

1. Field of the Invention

The invention relates to holders for comestible products and, more particularly, to holders for supporting tacos in a vertical orientation.

2. Description of the Prior Art

Certain types of comestible products such as hamburgers, tacos, and the like, include an edible portion such as a shell, bun, or other wrapper in which various foods are disposed. These comestible products usually are eaten by hand, rather than by the use of utensils. In the usual case, this means that the comestible products must be handled a certain number of times before they are completely consumed. In turn, foods disposed within the edible portion often are dislodged, with resultant messiness and waste.

Other problems occur in the preparation of the comestible products themselves. For example, when tacos are being made, the shell, which is made of a hardened tortilla in the shape of a trough-like structure, must be oriented vertically upwardly in order that various foods may be packed into the shell. If many tacos are to be prepared as, for example, in a restaurant production line, it is desirable that many tacos be made quickly and that they be handled as little as possible to prevent their contents from being spilled.

It is known to orient a plurality of taco shells vertically upwardly for loading, and various prior art devices could be used for that purpose, if desired. Unfortunately, no completely acceptable holder is available for supporting individual tacos in a vertically upward orientation for consumption, nor is any acceptable holder available for making a plurality of tacos and serving the plurality of tacos for consumption directly from the holder. Although various devices exist which theoretically could hold a taco or a plurality of tacos, all of these devices suffer drawbacks, such as excessive manufacturing expense, difficulty in cleaning, lack of capability to support a taco for ease of consumption, or lack of attractiveness to the consumer.

SUMMARY OF THE INVENTION

The invention overcomes the foregoing and other problems by providing an inexpensive, attractive holder for comestible products such as tacos or the like. The holder is characterized by a carrier having a trough-like channel opening vertically upwardly. The components of the holder are made of an opaque, plastic material susceptible of injection molding. Consequently, no screws, bolts, or other fasteners are needed to assemble the holders and the holders can be formed in attractive colors so as to stimulate consumer interest.

In one embodiment, the carrier is secured atop a stand having a plurality of legs. The legs are constructed such that when the holder is placed on a horizontal surface, the trough-like channel is oriented vertically upwardly. This embodiment of the invention is capable of holding a single comestible product, such as a single taco, and is intended to be used by individual consumers by placing the holder on a plate. The legs and supporting structure are arranged with respect to each other so that a plurality of holders may be stacked for compact storage.

Another embodiment of the invention comprises a plurality of identical carriers alinged atop, and secured to, a legged stand. The stand includes a planar sheet supported at an angle to the horizontal by legs of different lengths extending outwardly of the planar sheet at different angles. In order to increase the attractiveness and strength of the finished product, the legs also may be planar and may extend from one edge of the planar sheet to the other. The stand includes a plurality of slots into which portions of carriers of another holder can be fitted to permit compact storage.

The invention also includes a freestanding version in which a generally U-shaped carrier includes a flattened bottom portion which enables the carrier to rest atop a flat surface. The holder is of one-piece construction and it can be made sufficiently inexpensively that it can be disposed after use.

The foregoing advantages and a fuller understanding of the invention described and claimed herein may be had by referring to the following description and claims taken in conjunction with the accompanying drawings.

DESCRIPTION OF THE PREFERRED EMBODIMENT

Figure 1:
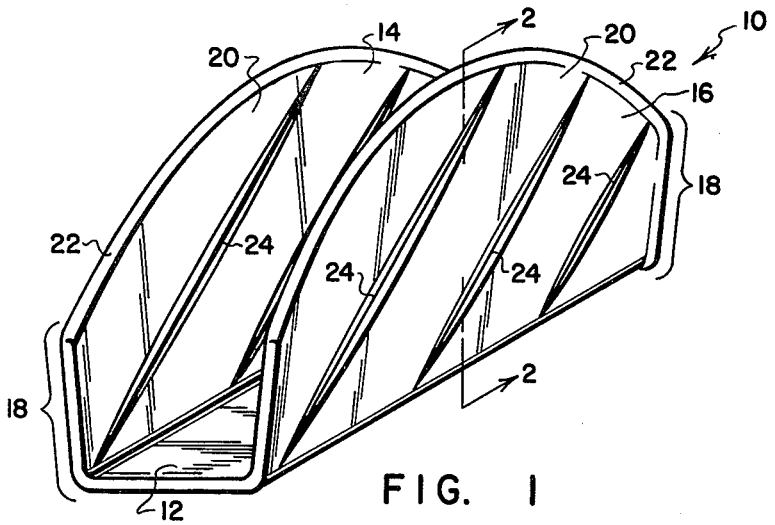
FIG. 1 is a perspective view of a freestanding holder according to the invention.

Referring to FIG. 1, a holder 10 for holding comestible products such as tacos or the like is shown. The holder 10 is comprised of an opaque, plastic material susceptible of injection molding. The particular embodiment of FIG. 1 is intended to be disposed after use and, accordingly, is formed by an inexpensive technique. Desirably, this technique is the so-called thermoform technique, whereby a drop of plastic material is placed in a heated mold where it expands to fill the mold. The details of the thermoform process are conventional, and need not be described here. It should be pointed out that the holder 10 produced by the thermoform process is very light, is stackable (FIG. 2), is capable of being produced in different colors, and in general presents an attractive appearance.

The holder 10 comprises a flattened, elongate bottom portion 12 and upstanding sidewalls 14, 16. The bottom 12 and sidewalls 14, 16 are intended to be quite thin and flexible. The sidewalls 14, 16 include a vertically extending section 18 at each end of the bottom portion 12 and an arched section 20 connecting the vertical section 18.

The holder 10 is sufficiently flexible that strengthening is needed. Strengthening is provided in the form of a thickened perimetric lip 22. The lip 22 extends along every exposed edge of the holder 10 and provides adequate support against excessive flexure. Additional support against flexure is provided by a plurality of strengthening ribs 24. The ribs 24 comprise shallow, generally V-shaped slots extending along the sidewalls 14, 16 at an angle from an upper portion of the sidewalls 14, 16 adjacent the arched section 20 to near the bottom portion 12. For ease of manufacture, and to prevent unnecessary distortion of the holder 10 near the perimetric lip 22, the ribs 24 are of decreasing dimension both depth-wise and width-wise toward the ends of the ribs.

Figure 2:
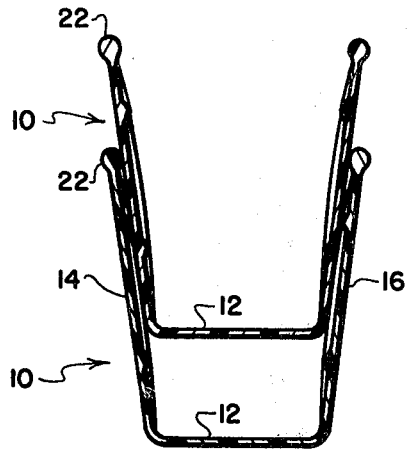
FIG. 2 is an end view of the holder of FIG. 1, showing a pair of similar holders assembled in stacked relationship.

Referring to FIG. 2, two holders 10 are shown in stacked relationship. This permits the holders to be stored compactly and is a decided advantage to consumers.

Figure 3:
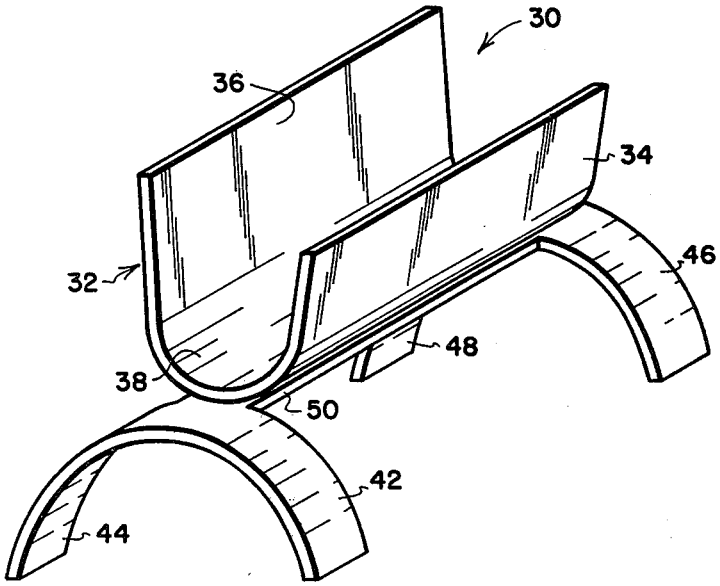
FIG. 3 is another embodiment of the invention in which a carrier defining a trough-like channel is supported atop a legged stand.
Figure 4:
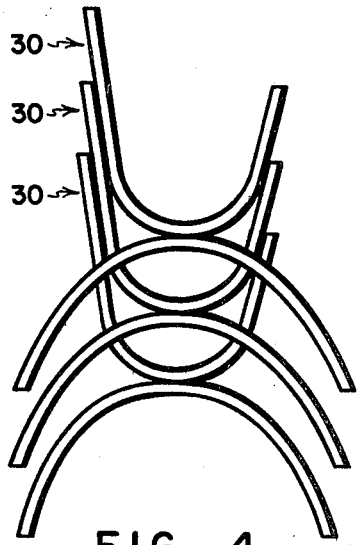
FIG. 4 is a side elevational view of the holder of FIG. 3 showing a plurality of similar holders assembled in stacked relationship.

Another embodiment of the invention is shown in FIGS. 3 and 4. A holder 30 includes an elongate, generally U-shaped carrier 32 forming a trough-like channel. The carrier 32 is of unitary construction and includes a front wall 34, a rear wall 36 taller than the front wall 34, and an interconnecting, curved bottom portion 38. The walls 34, 36 diverge slightly. This permits tacos or other comestible products to be easily placed into the carrier 32 or removed from the carrier 32. Such construction also facilitates stacking (FIG. 4).

The carrier 32 is supported atop a stand 40. When the stand 40 is placed on a horizontal surface, the troughlike channel opens vertically upwardly. The stand 40 includes a plurality of curved, depending legs 42, 44, 46, 48, one each disposed near a lower corner portion of the carrier 32. The legs 42, 44, 46, 48 are connected by an elongate portion 50. The portion 50 and the legs 42, 44, 46, 48 are of unitary construction. The stand 40 can be formed in a curved mold or a flat sheet of plastic material can be cut into a "H" shape and thereafter heated and bent into the configuration shown in FIG. 3. Alternatively, the entire holder 30 can be cut out of a single flat sheet of plastic material and bent into a configuration substantially similar to that shown in FIG. 3.

The carrier 32 is of a width slightly less than the width of the elongate portion 50. Accordingly, the legs 42, 44, 46, 48 extend laterally outwardly on either side of the carrier 32. This permits a plurality of the holders 30 to be stacked vertically, as best illustrated in FIG. 4.

Both the carrier 32 and the stand 40 are comprised of an opaque, plastic material such as high density polyethylene. The material is susceptible of injection molding and may be dyed in various colors to enhance consumer appeal. The holder 30, like the holder 10, is inexpensive to manufacture and is very easy to clean, largely because of the substantial unitary construction and smooth surfaces.

Figure 5:
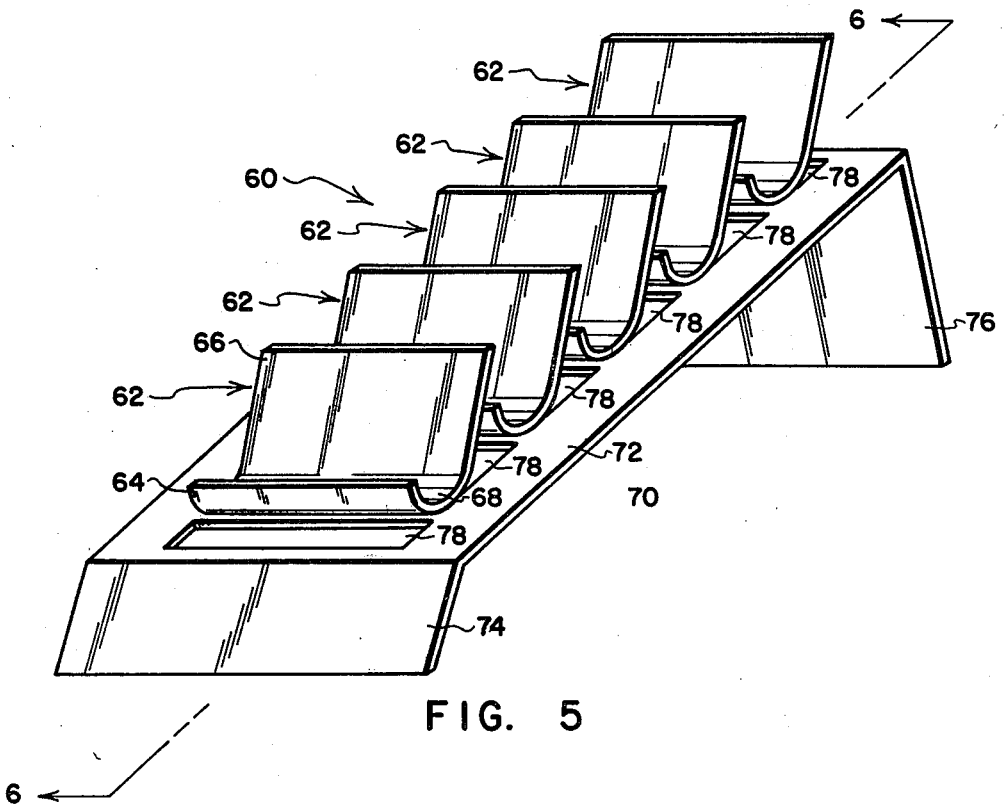
FIG. 5 is a perspective view of another embodiment of the invention in which a plurality of carriers are aligned atop, and secured to, a legged stand.
Figure 6:
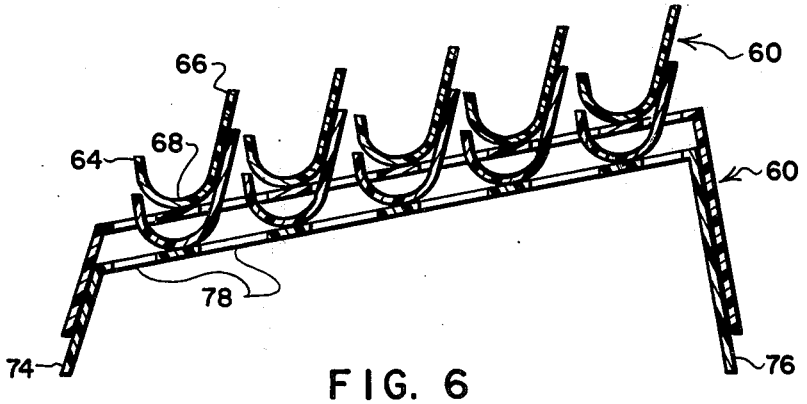
FIG. 6 is a side elevational view of the holder of FIG. 5, showing a pair of similar holders assembled in stacked relationship.

Yet another embodiment of the invention is shown in FIGS. 5 and 6. In this embodiment, a holder 60 comprises a plurality of identical, elongate, generally U-shaped carriers 62. The holder 60 may be made of the same type of material as that from which the holder 30 is made. Each carrier 62 may be similar or identical to the carrier 32, and includes a front wall 64, a rear wall 66 taller than the front wall 64, and a curved bottom portion 68 interconnecting the walls 64, 66. The walls 64, 66 diverge.

The carriers 62 are aligned atop, and secured to, a stand 70. The stand 70 includes a planar sheet 72 from which legs 74, 76 depend. The leg 74 is shorter than the leg 76 and extends outwardly of the planar sheet 72 at a different angle than the leg 76. The length of the legs 74, 76 and the angle at which they extend outwardly of the planar sheet 72 is selected such that the planar sheet 72 is inclined approximately 10 degrees to the horizontal when the legs are resting on a horizontal surface. For maximum stability, the legs 74, 76 may extend the full width of the planar sheet 72. The planar sheet 72 should be as wide, or wider than, the individual carriers 62 in order to provide maximum support for the carriers 62.

Referring to FIG. 6, the holder 60 can be stacked atop each other in closely fitting relationship. If desired, each planar sheet 72 may include a plurality of elongated slots 78. The slots 78 are disposed parallel to the rear walls 66 of the carriers 62 and are positioned intermediate the rear wall 66 and the front wall 64 of adjacent carriers 62. A slot is disposed intermediate the forwardmost carrier 62 and the attachment point for the leg 74. A slot 78 also is disposed intermediate the rearwardmost carrier 62 and the attachment point for the leg 76.

By this construction, the front walls 64 and the rear walls 66 of the carriers 62 of one holder can extend through the slots 78 of a vertically adjacent holder 60. The underside of the planar sheet 72 of the adjacent holder 60 thus will rest atop the carrier front walls 64 and the rear walls 66. The legs 74, 76 also will engage each other to assist in supporting the assembly. Compact stacking thus is facilitated.

Preferably, the stand 70 will be of unitary construction. This means that the stand will have maximum strength and yet various fasteners are not needed and places where deposits can collect essentially are eliminated. Moreover, the expense of the completed holder 60 is minimized and its attractiveness is enhanced.

Although the invention has been described with a certain degree of particularity, it will be appreciated that the present disclosure of the preferred embodiment has been made only by way of example. Numerous changes in the details of construction may be resorted to without departing from the true spirit and scope of the invention, and it is intended to encompass all such changes in the appended claims.

What is claimed is:

1. A holder for comestible products such as tacos or the like, comprising:

(a) an elongate, trough-like carrier, the carrier being generally U-shaped when viewed from the end and having relatively tall front and rear walls; and (b) a stand atop which the carrier is secured, the stand including a plurality of legs of generally equal length, at least one leg being disposed near lower corner portions of the carrier, the stand also including an elongate member having a length equal to, or greater than, the length of the carrier, the elongate member being secured to the carrier near the lowermost portion of the carrier, the elongate member including attachment points for the legs which are included as part of the stand, the attachment points being located laterally outwardly of the carrier.

2. The holder of claim 1, wherein the front and rear walls diverge.

3. The holder of claim 2, wherein the legs and the carrier are arranged with respect to each other so that vertically adjacent holders can be stacked compactly with the outside wall portions of the carrier of one holder resting atop inside wall portions of the carrier of another holder.

* * * * *